US009586212B2

(12) United States Patent
Silva et al.

(10) Patent No.: US 9,586,212 B2
(45) Date of Patent: Mar. 7, 2017

(54) DEPRESSOR IN IRON ORE FLOTATION COMPRISING SUGAR CANE BAGASSE, USE OF SUGAR CANE BAGASSE AS DEPRESSOR IN IRON ORE FLOTATION AND PROCESS OF PREPARING DEPRESSOR COMPRISING SUGAR CANE BAGASSE

(71) Applicant: VALE S.A., Rio de Janeiro (BR)

(72) Inventors: Marcílio do Carmo Silva, Mariana (BR); Cezar Gonçalves da Silva, Mariana (BR); Flávia Alice Monteiro da Silva Oliveira, Mariana (BR); Elismar Miquelanti, Mariana (BR)

(73) Assignee: VALE S.A., Rio de Janeiro (BR)

( * ) Notice: Subject to any disclaimer, the term of this patent is extended or adjusted under 35 U.S.C. 154(b) by 470 days.

(21) Appl. No.: 14/017,964

(22) Filed: Sep. 4, 2013

(65) Prior Publication Data

US 2014/0061101 A1 Mar. 6, 2014

Related U.S. Application Data

(60) Provisional application No. 61/696,710, filed on Sep. 4, 2012.

(51) Int. Cl.

| | |
|---|---|
| ***B03D 1/02*** | (2006.01) |
| ***B03D 1/018*** | (2006.01) |
| ***B03D 1/016*** | (2006.01) |
| ***B03D 1/002*** | (2006.01) |

(52) U.S. Cl.

CPC ..... *B03D 1/018* (2013.01); *B03D 1/002* (2013.01); *B03D 1/016* (2013.01); *B03D 1/02* (2013.01); *B03D 2201/06* (2013.01); *B03D 2203/04* (2013.01)

(58) Field of Classification Search

CPC ..... B03D 1/002

See application file for complete search history.

(56) References Cited

U.S. PATENT DOCUMENTS

| | | | |
|---|---|---|---|
| 4,808,301 | A | 2/1989 | Hansen et al. |
| 4,877,517 | A | 10/1989 | Bulatovic et al. |
| 5,049,612 | A | 9/1991 | Bulatovic et al. |
| 5,693,692 | A | 12/1997 | Bulatovic et al. |

FOREIGN PATENT DOCUMENTS

| | | | |
|---|---|---|---|
| BR | PI 0506244-6 | A | 8/2007 |
| CN | 102443071 | A | 5/2012 |
| SE | 464 336 | B | 4/1991 |

(Continued)

OTHER PUBLICATIONS

"Fractional extraction and structural characterization of sugarcane debasse hemicelluloses", J.X. Sun et al, Carbohydrate Polymers 56 (2004) pp. 195-204.*

(Continued)

*Primary Examiner* — Thomas M Lithgow
(74) *Attorney, Agent, or Firm* — Arent Fox LLP

(57) ABSTRACT

A depressor in iron ore flotation comprises sugar cane bagasse and caustic soda so as to assist in the iron ore flotation.

Sugar cane bagasse is used as a depressor in iron ore flotation, and a process of preparing depressor comprising sugar cane bagasse is disclosed.

16 Claims, 1 Drawing Sheet

(56) References Cited

FOREIGN PATENT DOCUMENTS

| | | | |
|---|---|---|---|
| WO | WO 89/04213 | A1 | 5/1989 |
| WO | WO 89/10791 | A1 | 11/1989 |
| WO | WO 00/62937 | A1 | 10/2000 |

OTHER PUBLICATIONS

Kumar, et al., "Reverse flotation studies on an Indian low grade iron ore slimes," International Journal of Engineering Science and Technology, 2010, pp. 637-648, vol. 2(4).

Nanthakumar, et al., "Anionic flotation of high-iron phosphate ores—Control of process water chemistry and depression of iron minerals by starch and guar gum," Int. J. Miner. Process. 92, 2009, pp. 49-57.

* cited by examiner

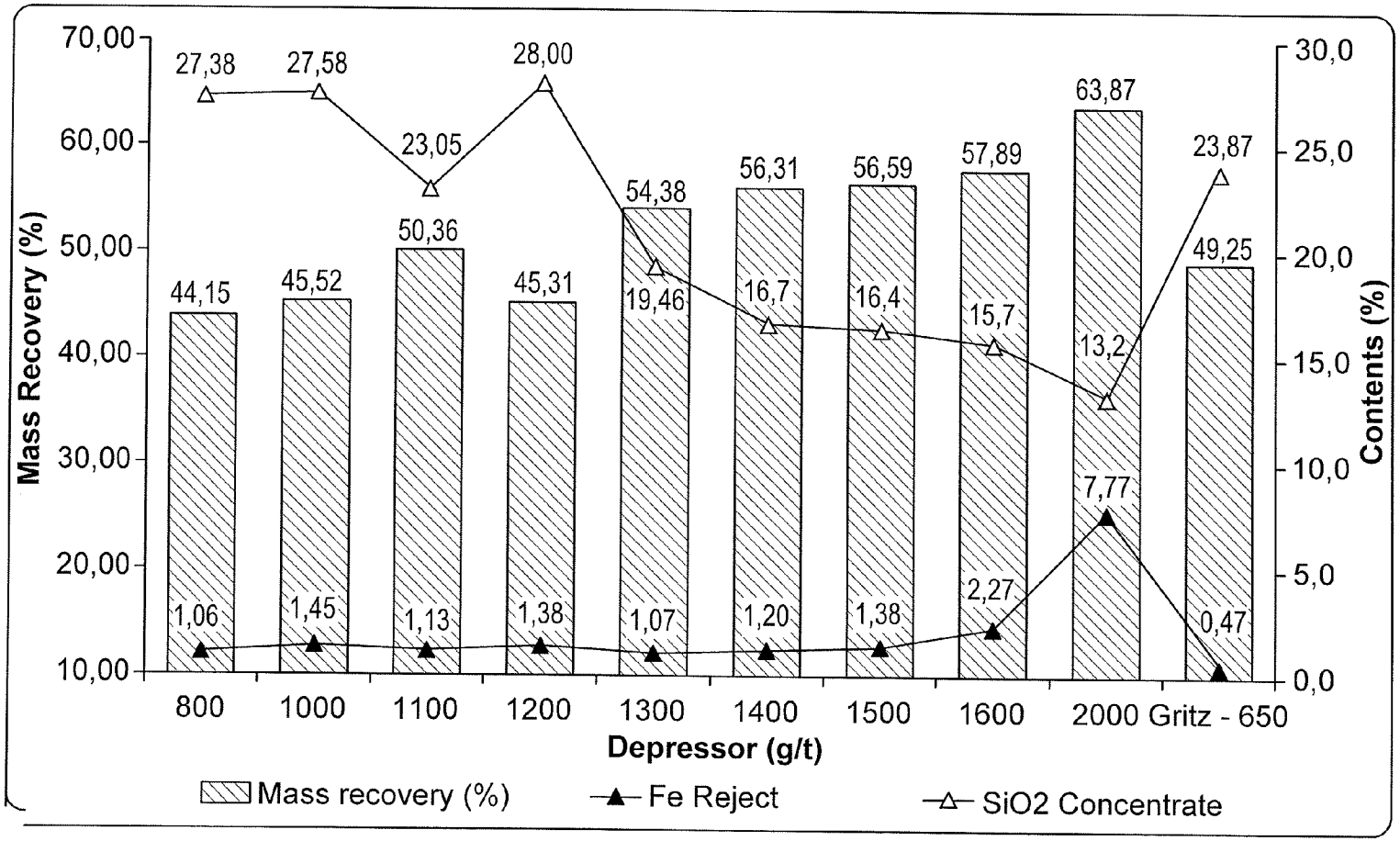
Contents (%)
30,0
25,0
20,0
15,0
10,0
5,0
0,0
Mass Recovery (%)
70,00
60,00
50,00
40,00
30,00
20,00
10,00
27,38
27,58
23,05
28,00
54,38
56,31
56,59
57,89
63,87
23,87
44,15
45,52
50,36
45,31
19,46
16,7
16,4
15,7
13,2
49,25
1,06
1,45
1,13
1,38
1,07
1,20
1,38
2,27
7,77
0,47
800
1000
1100
1200
1300
1400
1500
1600
2000 Gritz - 650
Depressor (g/t)
Mass recovery (%)
Fe Reject
SiO2 Concentrate

DEPRESSOR IN IRON ORE FLOTATION COMPRISING SUGAR CANE BAGASSE, USE OF SUGAR CANE BAGASSE AS DEPRESSOR IN IRON ORE FLOTATION AND PROCESS OF PREPARING DEPRESSOR COMPRISING SUGAR CANE BAGASSE

CROSS-REFERENCE TO RELATED APPLICATIONS

This application is based upon and claims benefit of priority of the U.S. Patent Application No. 61/696,710, filed Sep. 4, 2012, the disclosure of the prior application is hereby incorporated in its entirety by reference.

STATE OF THE ART

The concentration of minerals occurs when it is necessary to separate the minerals or metals of interest from those which are not. For this separation to occur, the minerals of interest cannot be physically aggregated to those which are not of interest. In such case, it is necessary to perform stages of fragmentation and classification so as to achieve this separation.

To perform the separation of minerals, there must be a physical or physical-chemical difference between the metal of interest and the other components in the mineral and it may be easy or highly complex, depending on the mineral. The most used physical properties in separating or concentrating minerals or metals are the difference in density or difference in magnetic susceptibility. In contrast, when there is no difference in minimal physical property between the minerals or metals that need to be separated, techniques are used based on the physical-chemical properties of the surface of the materials. The most widely used technique in this case is flotation. It is a highly versatile and selective process. It allows concentrates to be obtained that have high contents and significant recoveries. It is usually applied in the processing of minerals with low content and fine granulometry generally in an aqueous suspension. Furthermore, it is possible to use specific reagents, such as collectors, depressors and modifiers, which assist in the selective recovery of the minerals or metals of interest.

Starch is known to be used to assist in iron ore flotation in order to achieve lower iron contents in flotation reject of this mineral.

The present invention discloses a novel depressor to assist the flotation of the iron ore in order to obtain lower iron contents in the reject of said flotation.

DETAILED DESCRIPTION OF THE DRAWINGS

FIG. 1—evolution of the tests with greater depressor dosage.

DETAILED DESCRIPTION OF THE INVENTION

The present invention refers to a novel depressor to assist in the flotation of iron ore so as to obtain iron contents in the reject of said flotation in accordance with current standards.

More specifically, it refers to the use of sugar cane bagasse as depressor in iron ore flotation.

It further refers to a process of preparing depressor in iron ore flotation that comprises sugar cane bagasse and caustic soda.

Demonstrated below are preferred embodiments of a process of preparing depressor comprising sugar cane bagasse.

The process of preparing a depressor comprising treated sugar cane bagasse comprises the following stages:

a. mixing sugar cane bagasse with water, obtaining a first mixture;

b. adding caustic soda to the mixture above at a ratio of 6:1 to 10:1 part of bagasse: caustic soda, obtaining a second mixture;

c. letting it stand;

d. adding additional water, and e. agitating

The feed samples of the flotation (mineral) were filtered, homogenized and quartered, separating amounts of 1800 g for each test.

In a first preferred embodiment of the invention, the process of preparing a depressor comprising treated sugar cane bagasse comprises the following stages:

a. mixing 10 grams of the treated sugar cane bagasse with 250 ml of water, obtaining a first mixture;

b. after 5 minutes, adding caustic soda to the mixture above at a ratio of 8:1 part of bagasse: caustic soda, obtaining a second mixture;

c. letting it stand for a further 30 minutes;

d. adding water until reaching 1000 ml, and e. agitating for a further 10 minutes in an agitator, obtaining the depressor.

The total time for carrying out the process of preparing depressor comprising sugar cane bagasse is similar to the time for preparing an iron ore depressor comprising corn starch.

The depressor comprising sugar cane bagasse was conditioned for 3 minutes and amine (amine solution at 1%) for 1 minute.

The flotation of the iron ore using a depressor comprising sugar cane bagasse was carried out, and the reject was collected from 2 minutes to 2 minutes and 30 seconds.

The tests were carried out according to workbench test standards (flotation until exhaustion). The parameters used for the flotation tests are shown in table 1.

TABLE 1 parameters used in the tests.

| Test | 1 | 2 | 3 | 4 |
|---|---|---|---|---|
| pH | 10.8 | 10.0 | 10 | 10.05 |
| Depressor/ bagasse | 500 g/t | 700 g/t | 900 g/t | 1100 g/t |
| Amine | 180 g/t Sio2 | 180 g/t Sio2 | 180 g/t Sio2 | 180 g/t Sio2 |

Chemical results and flotation performance are shown in table 2 below.

TABLE 2

Chemical results.

| IDENTIFICATION | | Fe | SiO2 | P | Al2O3 | Mn | TiO2 |
|---|---|---|---|---|---|---|---|
| Tests 01 - 500 g/t | Concentrate | 66.710 | 1.720 | 0.043 | 0.300 | 0.156 | 0.049 |
| | Reject | 13.890 | 78.280 | 0.013 | 0.490 | 0.046 | 0.001 |
| Tests 01 - 700 g/t | Concentrate | 67.020 | 1.740 | 0.049 | 0.340 | 0.181 | 0.047 |
| | Reject | 21.550 | 67.840 | 0.010 | 0.400 | 0.016 | 0.001 |
| Tests 01 - 900 g/t | Concentrate | 67.050 | 1.250 | 0.047 | 0.310 | 0.172 | 0.047 |
| | Reject | 18.500 | 72.010 | 0.008 | 0.450 | 0.015 | 0.001 |
| Tests 01 - 1100 g/t | Concentrate | 66.670 | 1.910 | 0.045 | 0.340 | 0.161 | 0.039 |
| | Reject | 18.310 | 71.840 | 0.014 | 0.470 | 0.053 | 0.019 |

| IDENTIFICATION | | CaO | MgO | PPC |
|---|---|---|---|---|
| Tests 01 - 500 g/t | Concentrate | 0.011 | 0.018 | 1.70 |
| | Reject | 0.009 | 0.015 | 0.57 |
| Tests 01 - 700 g/t | Concentrate | 0.013 | 0.035 | 1.96 |
| | Reject | 0.006 | 0.043 | 0.30 |
| Tests 01 - 900 g/t | Concentrate | 0.014 | 0.001 | 1.89 |
| | Reject | 0.006 | 0.005 | 0.36 |
| Tests 01 - 1100 g/t | Concentrate | 0.011 | 0.071 | 1.76 |
| | Reject | 0.007 | 0.041 | 0.56 |

TABLE 3

Flotation performance.

| Complementary information | Test 1 | Test 2 | Test 3 | Test 4 |
|---|---|---|---|---|
| Mass recovery | 67.13 | 61.14 | 63.54 | 64.19 |
| Metal recovery | 90.75 | 83.03 | 86.33 | 86.71 |
| Gaudin selectivity index | 14.78 | 11.01 | 14.45 | 11.70 |

Analyzing the results shown in the tables above, the following is concluded:

with the cane bagasse, there was a delay in the discharge of the reject;

the pH used in test 1 (pH 9.5 to 11.0) showed better results of Fe content in the reject (13.89%).

In a second preferred embodiment of the invention, the process of preparing a depressor comprising sugar cane bagasse treated comprises the following stages:

a. mixing 10 grams of the sugar cane bagasse treated with 250 ml of water, obtaining a first mixture;

b. after 5 minutes, adding caustic soda to the mixture above in a ratio of 8:1 part of bagasse: caustic soda, obtaining a second mixture;

c. letting it stand for a further 30 minutes;

d. adding water until reaching 1000 ml, and e. agitating for a further 10 minutes in a mechanical agitator.

The product of this process is the depressor comprising sugar cane bagasse.

The total time for carrying out the process of preparing depressor comprising sugar cane bagasse is similar to the time for preparing an iron ore depressor comprising corn starch.

Preferably, the preparation of depressor (corn starch or BMC) together with NaOH may comprise the following additional stages:

i. Determining the humidity of the first mixture (sugar cane bagasse) before beginning the first mixture;

ii. Measuring the mass (30 to 40 g) of the material and annotating its value;

iii. Placing the material to dry in a hothouse at a temperature of 105° C. for about 2 hours;

iv. Withdrawing the material from the hothouse, v. Letting it cool for about 10 minutes, vi. Measuring the mass of the material stage v;

vii. Annotating the value of the mass after drying and calculating the humidity as follows:

$$UD = \left(1 - \frac{PS}{PU}\right) \times 100$$

Wherein:

UD=humidity of the material–sugar cane bagasse (%)

PS=dry weight of the material–sugar cane bagasse (g)

PU=wet weight of the material–sugar cane bagasse (g)

viii. Calculating the masses: material–sugar cane bagasse and sodium hydroxide using the formulae set forth below:

$$M_3 = \frac{C_3 \times M_4}{100}$$

$$M_5 = \frac{M_3}{100 - U} \times 100$$

$$M_6 = \frac{M_3}{Y} \times 2$$

Wherein:

$M_3$=dry mass of the material–sugar cane bagasse (g)

$C_3$=desired concentration of the depressor solution (%)

$M_4$=desired mass of the depressor solution (g)

$M_5$=wet mass of the material–sugar cane bagasse (g)

U=humidity of the material–sugar cane bagasse (%)

$M_6$=mass of caustic soda at 50% (g)

Y=numerator of the ratio sugar cane bagasse/caustic soda ix. Calculating the masses: gelatinization water and dilution:

$$M_7=(M_4\times 0.1)-M_5-M_6$$

$$M_8=M_4-M_5-M_6-M_7$$

Wherein:

$M_7$=mass of water for gelatinization at 10% (g)

$M_g$=mass of water for dilution of the solution to the desired concentration (g)

x. Positioning a recipient next to the agitator. If hot water is needed, use the agitator with heater;

xi. Adding gelatinization water (M7) into the recipient and agitate;

xii. Slowing adding the first mixture (M5) into the preparation recipient and wait for about 10 minutes;

xiii. Slowing adding the solution of caustic soda (M6);

xiv. Adjusting the rotation of the agitator so as to maintain the solution homogeneous during gelatinization;

xv. Waiting for about 20 minutes for full gelatinization of the second mixture;

xvi. Adding into the recipient the dilution water (M8) and waiting for about 10 minutes. If the recipient cannot accommodate all the mass, transfer the second mixture to a second recipient with greater capacity;

xvii. Switch off the agitator after 10 minutes;

xviii. Make the second prepared mixture available for use, protecting it from contaminations;

xix. After preparing the second mixture, check its concentration using a refractometer.

The flotation of the iron ore using a depressor comprising sugar cane bagasse was carried out, and the reject collected from 2 minutes to 2 minutes and 30 seconds.

The tests were carried out according to workbench test standards (flotation until exhaustion). The parameters used for the flotation tests are shown in table 1.

The parameters used for the flotation tests are shown in table 4.

| Test | Depressor (g/t) | Amine EDA-C (g/t $SiO_2$) | Ratio Starch/Caustic Soda | pH Test | pH Final | Time of Test(s) |
|---|---|---|---|---|---|---|
| 01 | Gritz - 650 | 190 | 8:1 | 9.5 | 8.6 | 180 |
| 02 | Gritz - 650 | 190 | 8:1 | 9.5 | 8.5 | 130 |
| 03 | BMC - 650 | 190 | 8:1 | 10.0 | 8.8 | 210 |
| 04 | BMC - 450 | 190 | 8:1 | 9.5 | 8.0 | 120 |
| 05 | BMC - 450 | 190 | 8:1 | 10.0 | 8.7 | 250 |
| 06 | BMC - 450 | 190 | 8:1 | 10.5 | 9.7 | 210 |
| 07 | BMC - 650 | 190 | 8:1 | 9.5 | 7.9 | 150 |
| 08 | BMC - 650 | 190 | 8:1 | 10.0 | 8.9 | 220 |
| 09 | BMC - 650 | 190 | 8:1 | 10.5 | 9.5 | 160 |
| 10 | BMC - 1200 | 190 | 10:1 | 10.5 | 9.3 | 85 |
| 11 | BMC - 2400 | 190 | 10:1 | 10.5 | 9.9 | 90 |
| 12 | BMC - 1200 | 90 | 10:1 | 10.5 | | 120 |
| 13 | BMC - 2400 | 90 | 10:1 | 10.5 | 10.2 | 90 |
| 14 | BMC - 1200 Dry | 90 | 10:1 | 10.5 | 9.8 | 95 |
| 15 | BMC - 2400 Dry | 90 | 10:1 | 10.5 | 10.0 | 96 |
| 16 | BMC - 450 | 90 | 10:1 | 9.5 | 7.9 | 130 |

The tests for evaluating the performance of the depressor are described in the table below.

| Test | Flow | Mass recovery (%) | Chemical Analysis (%) Fe | $SiO_2$ | P | $Al_2O_3$ | Mn | $TiO_2$ |
|---|---|---|---|---|---|---|---|---|
| 01 | Feed | 100.00 | 45.70 | 33.89 | 0.032 | 0.28 | 0.031 | 0.008 |
| | Concentrate | 47.49 | 68.16 | 0.54 | 0.054 | 0.31 | 0.062 | 0.019 |
| | Reject | 52.51 | 27.08 | 60.56 | 0.012 | 0.34 | 0.007 | 0.001 |
| 02 | Feed | 100.00 | 45.70 | 33.89 | 0.032 | 0.28 | 0.031 | 0.008 |
| | Concentrate | 49.25 | 67.86 | 0.47 | 0.052 | 0.33 | 0.059 | 0.016 |
| | Reject | 50.75 | 23.87 | 64.76 | 0.007 | 0.32 | 0.001 | 0.001 |
| 03 | Feed | 100.00 | 45.70 | 33.89 | 0.032 | 0.28 | 0.031 | 0.008 |
| | Concentrate | 16.90 | 66.73 | 0.87 | 0.088 | 0.41 | 0.124 | 0.015 |
| | Reject | 83.10 | 41.96 | 38.32 | 0.020 | 0.34 | 0.018 | 0.005 |
| 04 | Feed | 100.00 | 45.70 | 33.89 | 0.032 | 0.28 | 0.031 | 0.008 |
| | Concentrate | 20.43 | 66.77 | 1.09 | 0.083 | 0.39 | 0.120 | 0.013 |
| | Reject | 79.57 | 40.49 | 40.77 | 0.017 | 0.31 | 0.006 | 0.006 |
| 05 | Feed | 100.00 | 45.70 | 33.89 | 0.032 | 0.28 | 0.031 | 0.008 |
| | Concentrate | 15.83 | 65.68 | 1.06 | 0.088 | 0.46 | 0.134 | 0.015 |
| | Reject | 84.17 | 42.03 | 39.08 | 0.017 | 0.29 | 0.008 | 0.005 |
| 06 | Feed | 100.00 | 45.70 | 33.89 | 0.032 | 0.28 | 0.031 | 0.008 |
| | Concentrate | 12.32 | 65.84 | 0.82 | 0.095 | 0.45 | 0.148 | 0.012 |
| | Reject | 87.68 | 43.01 | 37.25 | 0.020 | 0.29 | 0.013 | 0.005 |
| 07 | Feed | 100.00 | 45.70 | 33.89 | 0.032 | 0.28 | 0.031 | 0.008 |
| | Concentrate | 21.57 | 66.34 | 1.20 | 0.080 | 0.42 | 0.123 | 0.014 |
| | Reject | 78.43 | 40.10 | 41.56 | 0.016 | 0.30 | 0.004 | 0.005 |
| 08 | Feed | 100.00 | 45.70 | 33.89 | 0.032 | 0.28 | 0.031 | 0.008 |
| | Concentrate | 13.46 | 66.11 | 0.75 | 0.096 | 0.43 | 0.149 | 0.012 |
| | Reject | 86.54 | 42.56 | 37.56 | 0.019 | 0.30 | 0.011 | 0.006 |
| 09 | Feed | 100.00 | 45.70 | 33.89 | 0.032 | 0.28 | 0.031 | 0.008 |
| | Concentrate | 14.84 | 65.91 | 0.90 | 0.087 | 0.40 | 0.130 | 0.013 |
| | Reject | 85.16 | 42.11 | 38.29 | 0.018 | 0.29 | 0.012 | 0.006 |
| 10 | Feed | 100.00 | 45.70 | 33.89 | 0.032 | 0.28 | 0.031 | 0.008 |
| | Concentrate | 22.79 | 65.89 | 0.95 | 0.077 | 0.34 | 0.098 | 0.012 |
| | Reject | 77.21 | 39.56 | 42.03 | 0.015 | 0.33 | 0.009 | 0.003 |
| 11 | Feed | 100.00 | 45.70 | 33.89 | 0.032 | 0.28 | 0.031 | 0.008 |
| | Concentrate | 42.05 | 67.35 | 0.87 | 0.056 | 0.28 | 0.069 | 0.016 |
| | Reject | 57.95 | 29.74 | 57.04 | 0.011 | 0.34 | 0.003 | 0.001 |
| 12 | Feed | 100.00 | 45.70 | 33.89 | 0.032 | 0.28 | 0.031 | 0.008 |
| | Concentrate | 45.31 | 66.84 | 1.38 | 0.059 | 0.31 | 0.068 | 0.016 |
| | Reject | 54.69 | 28.00 | 59.86 | 0.005 | 0.30 | 0.001 | 0.001 |
| 13 | Feed | 100.00 | 45.70 | 33.89 | 0.032 | 0.28 | 0.031 | 0.008 |
| | Concentrate | 65.01 | 63.20 | 6.96 | 0.041 | 0.27 | 0.050 | 0.016 |
| | Reject | 34.99 | 10.92 | 82.58 | 0.004 | 0.36 | 0.001 | 0.001 |
| 14 | Feed | 100.00 | 45.70 | 33.89 | 0.032 | 0.28 | 0.031 | 0.008 |
| | Concentrate | 47.22 | 66.85 | 1.55 | 0.054 | 0.31 | 0.066 | 0.018 |
| | Reject | 52.78 | 26.99 | 60.99 | 0.005 | 0.31 | 0.001 | 0.001 |
| 15 | Feed | 100.00 | 45.70 | 33.89 | 0.032 | 0.28 | 0.031 | 0.008 |
| | Concentrate | 67.45 | 60.16 | 11.39 | 0.040 | 0.30 | 0.046 | 0.012 |
| | Reject | 32.55 | 15.23 | 77.71 | 0.003 | 0.34 | 0.001 | 0.001 |
| 16 | Feed | 100.00 | 45.70 | 33.89 | 0.032 | 0.28 | 0.031 | 0.008 |
| | Concentrate | 30.60 | 66.02 | 1.86 | 0.067 | 0.35 | 0.090 | 0.014 |
| | Reject | 69.40 | 36.39 | 46.58 | 0.009 | 0.29 | 0.001 | 0.001 |

| Test | Flow | Mass recovery (%) | Chemical Analysis (%) CaO | MgO | PPC |
|---|---|---|---|---|---|
| 01 | Feed | 100.00 | 0.001 | 0.001 | 1.35 |
| | Concentrate | 47.49 | 0.001 | 0.001 | 2.16 |
| | Reject | 52.51 | 0.001 | 0.001 | 0.75 |
| 02 | Feed | 100.00 | 0.001 | 0.001 | 1.35 |
| | Concentrate | 49.25 | 0.001 | 0.001 | 2.15 |
| | Reject | 50.75 | 0.001 | 0.001 | 0.59 |
| 03 | Feed | 100.00 | 0.001 | 0.001 | 1.35 |
| | Concentrate | 16.90 | 0.001 | 0.001 | 3.68 |
| | Reject | 83.10 | 0.001 | 0.001 | 1.09 |
| 04 | Feed | 100.00 | 0.001 | 0.001 | 1.35 |
| | Concentrate | 20.43 | 0.001 | 0.001 | 3.43 |
| | Reject | 79.57 | 0.001 | 0.001 | 0.83 |
| 05 | Feed | 100.00 | 0.001 | 0.001 | 1.35 |
| | Concentrate | 15.83 | 0.001 | 0.001 | 3.72 |
| | Reject | 84.17 | 0.001 | 0.001 | 0.87 |
| 06 | Feed | 100.00 | 0.001 | 0.001 | 1.35 |
| | Concentrate | 12.32 | 0.001 | 0.001 | 4.03 |
| | Reject | 87.68 | 0.001 | 0.001 | 0.95 |
| 07 | Feed | 100.00 | 0.001 | 0.001 | 1.35 |
| | Concentrate | 21.57 | 0.002 | 0.001 | 3.53 |
| | Reject | 78.43 | 0.001 | 0.001 | 0.73 |

-continued

| | | | | | |
|---|---|---|---|---|---|
| 08 | Feed | 100.00 | 0.001 | 0.001 | 1.35 |
| | Concentrate | 13.46 | 0.001 | 0.001 | 4.02 |
| | Reject | 86.54 | 0.001 | 0.001 | 0.93 |
| 09 | Feed | 100.00 | 0.001 | 0.001 | 1.35 |
| | Concentrate | 14.84 | 0.001 | 0.001 | 3.77 |
| | Reject | 85.16 | 0.001 | 0.001 | 0.90 |
| 10 | Feed | 100.00 | 0.001 | 0.001 | 1.35 |
| | Concentrate | 22.79 | 0.005 | 0.001 | 3.44 |
| | Reject | 77.21 | 0.001 | 0.001 | 0.84 |
| 11 | Feed | 100.00 | 0.001 | 0.001 | 1.35 |
| | Concentrate | 42.05 | 0.001 | 0.001 | 2.58 |
| | Reject | 57.95 | 0.001 | 0.001 | 0.60 |
| 12 | Feed | 100.00 | 0.001 | 0.001 | 1.35 |
| | Concentrate | 45.31 | 0.001 | 0.001 | 2.44 |
| | Reject | 54.69 | 0.001 | 0.001 | 0.48 |
| 13 | Feed | 100.00 | 0.001 | 0.001 | 1.35 |
| | Concentrate | 65.01 | 0.001 | 0.001 | 2.03 |
| | Reject | 34.99 | 0.001 | 0.001 | 0.48 |
| 14 | Feed | 100.00 | 0.001 | 0.001 | 1.35 |
| | Concentrate | 47.22 | 0.001 | 0.001 | 2.38 |
| | Reject | 52.78 | 0.001 | 0.001 | 0.50 |
| 15 | Feed | 100.00 | 0.001 | 0.001 | 1.35 |
| | Concentrate | 67.45 | 0.001 | 0.001 | 1.94 |
| | Reject | 32.55 | 0.001 | 0.001 | 0.54 |
| 16 | Feed | 100.00 | 0.001 | 0.001 | 1.35 |
| | Concentrate | 30.60 | 0.001 | 0.001 | 2.94 |
| | Reject | 69.40 | 0.001 | 0.001 | 0.66 |

It is possible to conclude that the depressor comprising sugar cane bagasse works. Furthermore, it can be noted that the best performance of the flotation, in terms of yield mass and optimum content of $SiO_2$ in the concentrate, was obtained in test 12, with dosage of BMC (depressor) at 1200 g/t fed, amine dosage at 90 g/t $SiO_2$, ratio BMC/caustic soda 10:1 and pH 10.5.

Based on this result, new tests were carried out with greater dosages of the depressor and a low dosage of amine 90 g/t $SiO_2$. The parameters used for the flotation tests are shown in table below.

| Test | Depressor (g/t) | Amine EDA-C (g/t $SiO_2$) | pH Test | pH Final | Time of Test(s) |
|---|---|---|---|---|---|
| 01 | 800 | 90 | 10.50 | 9.8 | 120 |
| 02 | 1000 | 90 | 10.50 | 8.9 | 118 |
| 03 | 1100 | 90 | 10.50 | 9.8 | 119 |
| 04 | 1300 | 90 | 10.50 | 9.5 | 121 |
| 05 | 1400 | 90 | 10.50 | 9.8 | 115 |
| 06 | 1500 | 90 | 10.50 | 9.9 | 121 |
| 07 | 1600 | 90 | 10.50 | 9.9 | 122 |
| 08 | 2000 | 90 | 10.50 | 9.9 | 119 |

The table below shows the results obtained with these new parameters:

| | | Mass recovery | Chemical Analysis (%) | | | | | |
|---|---|---|---|---|---|---|---|---|
| Test | Flow | (%) | Fe | $SiO_2$ | P | $Al_2O_3$ | Mn | PPC |
| 01 | Feed | 100.00 | 45.70 | 33.89 | 0.032 | 0.28 | 0.031 | 1.35 |
| | Concentrate | 44.15 | 66.56 | 1.06 | 0.062 | 0.44 | 0.062 | 2.44 |
| | Reject | 55.85 | 27.38 | 59.79 | 0.008 | 0.39 | 0.001 | 0.48 |
| 02 | Feed | 100.00 | 45.70 | 33.89 | 0.032 | 0.28 | 0.031 | 1.35 |
| | Concentrate | 45.52 | 67.20 | 1.45 | 0.058 | 0.44 | 0.065 | 2.44 |
| | Reject | 54.48 | 27.58 | 60.03 | 0.008 | 0.19 | 0.009 | 0.45 |
| 03 | Feed | 100.00 | 45.70 | 33.89 | 0.032 | 0.28 | 0.031 | 1.35 |
| | Concentrate | 50.36 | 67.61 | 1.13 | 0.053 | 0.44 | 0.060 | 2.29 |
| | Reject | 49.64 | 23.05 | 67.15 | 0.005 | 0.41 | 0.001 | 0.43 |
| 04 | Feed | 100.00 | 45.70 | 33.89 | 0.032 | 0.28 | 0.031 | 1.35 |
| | Concentrate | 54.38 | 67.01 | 1.07 | 0.052 | 0.43 | 0.056 | 2.13 |
| | Reject | 45.62 | 19.46 | 71.51 | 0.004 | 0.47 | 0.001 | 0.45 |
| 05 | Feed | 100.00 | 45.70 | 33.89 | 0.032 | 0.28 | 0.031 | 1.35 |
| | Concentrate | 56.31 | 67.06 | 1.20 | 0.051 | 0.44 | 0.054 | 2.02 |
| | Reject | 43.69 | 16.74 | 74.68 | 0.009 | 0.46 | 0.001 | 0.44 |
| 06 | Feed | 100.00 | 45.70 | 33.89 | 0.032 | 0.28 | 0.031 | 1.35 |
| | Concentrate | 56.59 | 67.46 | 1.38 | 0.053 | 0.44 | 0.054 | 2.13 |
| | Reject | 43.41 | 16.45 | 75.60 | 0.004 | 0.42 | 0.001 | 0.44 |
| 07 | Feed | 100.00 | 45.70 | 33.89 | 0.032 | 0.28 | 0.031 | 1.35 |
| | Concentrate | 57.89 | 66.79 | 2.27 | 0.046 | 0.42 | 0.054 | 2.11 |
| | Reject | 42.11 | 15.79 | 76.26 | 0.003 | 0.43 | 0.001 | 0.45 |
| 08 | Feed | 100.00 | 45.70 | 33.89 | 0.032 | 0.28 | 0.031 | 1.35 |
| | Concentrate | 63.87 | 63.36 | 7.77 | 0.043 | 0.40 | 0.049 | 2.00 |
| | Reject | 36.13 | 13.24 | 79.27 | 0.004 | 0.42 | 0.001 | 0.47 |

| | | Mass recovery | Chemical Analysis (%) | | | |
|---|---|---|---|---|---|---|
| Test | Flow | (%) | $TiO_2$ | CaO | MgO | PPC |
| 01 | Feed | 100.00 | 0.008 | 0.001 | 0.001 | 1.35 |
| | Concentrate | 44.15 | 0.019 | 0.012 | 0.254 | 2.44 |
| | Reject | 55.85 | 0.001 | 0.008 | 0.215 | 0.48 |
| 02 | Feed | 100.00 | 0.008 | 0.001 | 0.001 | 1.35 |
| | Concentrate | 45.52 | 0.019 | 0.015 | 0.001 | 2.44 |
| | Reject | 54.48 | 0.001 | 0.013 | 0.001 | 0.45 |
| 03 | Feed | 100.00 | 0.008 | 0.001 | 0.001 | 1.35 |
| | Concentrate | 50.36 | 0.018 | 0.017 | 0.001 | 2.29 |
| | Reject | 49.64 | 0.001 | 0.008 | 0.001 | 0.43 |
| 04 | Feed | 100.00 | 0.008 | 0.001 | 0.001 | 1.35 |
| | Concentrate | 54.38 | 0.020 | 0.021 | 0.001 | 2.13 |
| | Reject | 45.62 | 0.001 | 0.019 | 0.001 | 0.45 |
| 05 | Feed | 100.00 | 0.008 | 0.001 | 0.001 | 1.35 |
| | Concentrate | 56.31 | 0.020 | 0.019 | 0.001 | 2.02 |
| | Reject | 43.69 | 0.001 | 0.023 | 0.001 | 0.44 |
| 06 | Feed | 100.00 | 0.008 | 0.001 | 0.001 | 1.35 |
| | Concentrate | 56.59 | 0.020 | 0.026 | 0.001 | 2.13 |
| | Reject | 43.41 | 0.001 | 0.014 | 0.001 | 0.44 |
| 07 | Feed | 100.00 | 0.008 | 0.001 | 0.001 | 1.35 |
| | Concentrate | 57.89 | 0.021 | 0.013 | 0.001 | 2.11 |
| | Reject | 42.11 | 0.001 | 0.012 | 0.001 | 0.45 |
| 08 | Feed | 100.00 | 0.008 | 0.001 | 0.001 | 1.35 |
| | Concentrate | 63.87 | 0.017 | 0.011 | 0.001 | 2.00 |
| | Reject | 36.13 | 0.001 | 0.008 | 0.001 | 0.47 |

It is noted that with the use of lower dosages of amine excellent results were obtained in the quality of the concentrate and mass yield. The tests confirm the use of cane bagasse as a depressor of iron ore in reverse flotation.

The invention claimed is:

1. A process of preparing a depressor in iron ore flotation, comprising:

a. mixing sugar cane bagasse with water, obtaining a first mixture comprising the sugar cane bagasse and the water;

b. adding caustic soda to the first mixture at a weight ratio of 6:1 to 10:1 of sugar cane bagasse:caustic soda, thereby obtaining a second mixture comprising the sugar cane bagasse, the water, and the caustic soda;

c. letting the second mixture stand;

d. adding additional water to the second mixture, thereby obtaining a third mixture comprising the sugar cane bagasse, the water, the caustic soda, and the additional water, and e. agitating.

2. The process of preparing a depressor in iron flotation of claim 1, wherein said ratio between bagasse: caustic soda is preferably 8:1.

3. The process according to claim 1, wherein the caustic soda is added to the first mixture at a weight ratio of 8:1 part of sugar cane bagasse:caustic soda.

4. The process according to claim 1, wherein in step "c" the second mixture stands for 30 minutes.

5. The process according to claim 1, wherein water is added until reaching 1000 ml.

6. The process according to claim 1, wherein the agitating includes agitation for 10 minutes in a mechanical agitator.

7. The process according to claim 1, wherein the pH is between 9.5 and 11.0.

8. A process of preparing a depressor in iron ore flotation, comprising:

measuring a mass of an amount of sugar cane bagasse;

drying the sugar cane bagasse in a hothouse at a temperature of 105° C for about 2 hours;

withdrawing the sugar cane bagasse from the hothouse and letting the sugar cane bagasse cool for about 10 minutes;

measuring the mass of the sugar cane bagasse after the cooling;

calculating a humidity of the sugar cane bagasse based on the mass measured prior to the drying and the mass measured after the cooling;

adding a first water into a recipient and agitating with an agitator;

adding the sugar cane bagasse into the recipient and waiting for about 10 minutes to obtain a first mixture;

slowing adding a solution of caustic soda to the recipient to obtain a second mixture;

adjusting a rotation of the agitator so as to maintain a homogeneous solution of the second mixture during gelatinization;

waiting for about 20 minutes for full gelatinization;

adding into the recipient a second water and waiting for about 10 minutes to obtain a third mixture;

switching off the agitator after 10 minutes;

protecting the third mixture from contaminations; and after preparing the third mixture, checking a concentration using of the third mixture via a refractometer.

9. A depressor in iron ore flotation, comprising:

sugar cane bagasse;

NaOH; and water;

wherein a weight ratio of the sugar cane bagasse to the NaOH is in a range from 6:1 to 10:1.

10. A method of assisting iron ore floatation in a suspension comprising iron ore, the method comprising:

adding a depressor to the suspension including iron ore, wherein the depressor comprises sugar cane bagasse.

11. A process of preparing a depressor in iron ore flotation, comprising:

measuring a mass of a first amount of sugar cane bagasse;

drying the first amount of the sugar cane bagasse in a hothouse after the measuring;

measuring the mass of the first amount of sugar cane bagasse after the drying;

calculating a humidity of the sugar cane bagasse based on the mass measured prior to the drying and the mass measured after the drying;

calculating a second amount of the sugar cane bagasse and an amount of a caustic soda sufficient to provide a predetermined concentration and a predetermined mass of the depressor based on the calculated humidity;

mixing the second amount of the sugar cane bagasse with a first water to obtain a first mixture;

adding the calculated amount of the caustic soda to the first mixture to obtain a second mixture; and adding a second water to the second mixture to obtain a third mixture.

12. The process of claim 11, further comprising:

calculating an amount of the first water based on the predetermined mass of the depressor, the second amount of the sugar cane bagasse, and the amount of the caustic soda; and calculating an amount of the second water based on the predetermined mass of the depressor, the second amount for the sugar cane bagasse, the amount of the caustic soda, and the amount of the first water;

wherein the mixing includes mixing using the calculated amount of the first water; and wherein the adding includes adding using the calculated amount of the second water.

13. The process of claim 11, further comprising allowing the second mixture to fully gelatinize.

14. The process of claim 11, further comprising agitating during the mixing of the second amount of sugar cane bagasse with the first water, during the adding of the amount of the caustic soda to the first mixture, and during the adding of the second water to the second mixture.

15. The process of claim 11, wherein the caustic soda comprises NaOH.

16. The process of claim 11, further comprising checking a concentration of the third mixture via a refractometer.

* * * * *